US009653858B2

(12) United States Patent
Hanke et al.

(10) Patent No.: US 9,653,858 B2
(45) Date of Patent: May 16, 2017

(54) WALL FEED-THROUGH DEVICE

(71) Applicant: Weidmueller Interface GmbH & Co. KG, Detmold (DE)

(72) Inventors: Dirk Hanke, Lemgo (DE); Johann Klippenstein, Oelde (DE); Peter Stuckmann, Lage (DE); Peter Walker, Midlothian, VA (US)

(73) Assignee: Weidmueller Interface GMBH & Co. KG (DE)

( * ) Notice: Subject to any disclaimer, the term of this patent is extended or adjusted under 35 U.S.C. 154(b) by 0 days.

(21) Appl. No.: 14/909,984

(22) PCT Filed: Jun. 23, 2014

(86) PCT No.: PCT/EP2014/063170
§ 371 (c)(1),
(2) Date: Feb. 3, 2016

(87) PCT Pub. No.: WO2015/032516
PCT Pub. Date: Mar. 12, 2015

(65) Prior Publication Data

US 2016/0164230 A1 Jun. 9, 2016

(30) Foreign Application Priority Data

Sep. 9, 2013 (DE) ..... 20 2013 104 068

(51) Int. Cl.
*H01R 13/73* (2006.01)
*H01R 13/74* (2006.01)
(Continued)

(52) U.S. Cl.
CPC ..... *H01R 13/74* (2013.01); *H01R 11/32* (2013.01); *H01R 13/04* (2013.01); *H01R 13/112* (2013.01);
(Continued)

(58) Field of Classification Search
CPC .... H01R 29/00; H01R 13/6215; H01R 31/08; H01R 13/74; H01R 13/6271;
(Continued)

(56) References Cited

U.S. PATENT DOCUMENTS 4,040,699 A * 8/1977 Rasmussen ..... H01R 24/62 439/344
5,496,188 A * 3/1996 Okamura ..... H01R 31/08 439/189
(Continued)

FOREIGN PATENT DOCUMENTS

DE 1 127 977 A 4/1962
DE 10 2007 006 645 A1 8/2008
(Continued)

*Primary Examiner* — Thanh Tam Le
(74) *Attorney, Agent, or Firm* — Laubscher, Spendlove & Laubscher, P.C.

(57) ABSTRACT

A connector assembly for transmitting electrical energy through a wall opening, including a horizontal generally-rectangular first connector housing arranged on one side of the wall with a collar portion of the first housing extending through the wall opening. The collar portion contains a plurality of horizontal parallel coplanar first through bores in which are mounted a plurality of electrically conductive spring contacts, respectively. A second connector housing arranged on the other side of the wall opening contains a recess receiving the collar portion, and a plurality of second bores extending collinearly opposite the first bores, respectively. An electrically conductive comb member includes a plurality of integral pin portions that extend from a common spine portion through the second bores and into the first bores for electrical engagement with the spring contacts, respectively, thereby to connect conductors arranged on opposite sides of the wall.

5 Claims, 3 Drawing Sheets

(51) Int. Cl.

| | |
|---|---|
| ***H01R 11/32*** | (2006.01) |
| ***H01R 13/04*** | (2006.01) |
| ***H01R 13/11*** | (2006.01) |
| ***H01R 24/28*** | (2011.01) |
| *H01R 4/02* | (2006.01) |
| *H01R 101/00* | (2006.01) |

(52) U.S. Cl.
CPC ..... *H01R 13/748* (2013.01); *H01R 24/28* (2013.01); *H01R 4/02* (2013.01); *H01R 2101/00* (2013.01)

(58) Field of Classification Search
CPC H01R 13/748; H01R 13/745; H01R 13/4223; H01R 23/7057; H01R 23/7042
USPC ..... 439/189, 362, 364, 373, 511, 544, 562, 439/564, 565, 595, 571–573
See application file for complete search history.

(56) References Cited

U.S. PATENT DOCUMENTS

| | | | | |
|---|---|---|---|---|
| 5,788,519 | A * | 8/1998 | Stern | H01R 31/085 439/189 |
| 6,273,756 | B1 * | 8/2001 | Ward | H01R 13/6596 439/372 |
| 7,121,879 | B1 * | 10/2006 | Chou | H01R 13/6395 439/357 |
| 7,192,305 | B2 * | 3/2007 | Kato | H01R 13/74 439/544 |
| 7,335,054 | B2 * | 2/2008 | Nakazawa | H01R 31/08 439/510 |
| 7,410,386 | B2 | 8/2008 | Fabian et al. | |
| 7,494,374 | B2 * | 2/2009 | Hall | H01R 13/748 439/564 |
| 7,883,362 | B2 * | 2/2011 | Ichio | H01R 13/40 439/511 |
| 8,231,399 | B2 * | 7/2012 | Daubigney | H01R 13/6275 439/247 |
| 8,333,622 | B2 * | 12/2012 | Blasko | H01R 13/113 439/595 |
| 8,771,003 | B2 * | 7/2014 | Reibke | H01R 13/748 439/372 |
| 8,992,251 | B2 * | 3/2015 | Smutny | H01R 31/08 439/511 |
| 2007/0207652 | A1 | 9/2007 | Tsuruta | |

FOREIGN PATENT DOCUMENTS

| | | | |
|---|---|---|---|
| DE | 20 2009 005 809 | U1 | 10/2010 |
| DE | 20 2013 101 698 | U1 | 9/2013 |
| EP | 0 206 320 | A2 | 12/1986 |
| JP | 2000077140 | A | 3/2000 |
| JP | 2001110478 | A | 4/2001 |
| JP | 2001257044 | A | 9/2001 |
| JP | 2005327561 | A | 11/2005 |
| WO | 2013/035268 | A1 | 3/2013 |

* cited by examiner

WALL FEED-THROUGH DEVICE

REFERENCE TO RELATED APPLICATIONS

This application is a national stage application under 35 C.F.R. §371 of the PCT International Application No. PCT/EP2014/063170 filed Jun. 23, 2014, which claims priority of the German application No. DE 20 2013 104 068.1 filed Sep. 9, 2013.

BACKGROUND OF THE INVENTION

Field of the Invention

A connector assembly serves to distribute electrical energy between conductors arranged on opposite sides of a wall opening, including first and second connector housings arranged on opposite sides of the wall, and a conductive comb member having pin portions that extend through second bores contained in the second housing for electrical engagement with spring contacts arranged in corresponding aligned first bores contained in the first housing.

Description of Related Art

A wall on which the wall opening connector assembly is to be fastened can be the wall of a circuit breaker cabinet according to the prior art and also according to the invention. It is often necessary to place several conductors at a plug connector on one side of the wall at a potential and to lead this potential conductively through the wall. For this, two plug connectors are mated on both sides of the wall in the region of an opening in the wall, with corresponding contacts of the two plug connectors being conductively joined together.

According to the prior art, oftentimes screw contacts are used in order to make the conductive connection or to connect the conductor to the plug connectors. Then, as a rule, several conductor ends or bus bars or the like are connected to the two plug connectors. This brings the problem that it may be necessary in a harsh environment to tighten up the screws of these screw contacts from time to time, which is relatively time-consuming. Furthermore, the diversity of parts is relatively high.

Given this background, the problem which the invention proposes to solve is to provide a wall duct unit of simplified design and optimized in regard to its maintenance expense.

SUMMARY OF THE INVENTION

Accordingly, a primary object of the present invention is to provide a connector assembly for conducting electrical energy through a wall opening between conductors arranged on opposite sides of the wall.

A more specific object is to provide a conductor assembly including first and second connector housings arranged on opposite sides of the wall, and a conductive comb member having pin portions that extend through second bores contained in the second housing for electrical engagement with spring contacts arranged contained in corresponding aligned first bores contained in a collar portion of the first housing that extends into the wall opening.

Another object of the invention is to provide a connector arrangement including a horizontal generally-rectangular first connector housing arranged on one side of the wall with a collar portion of the first housing extending through the wall opening. The collar portion contains a plurality of horizontal parallel coplanar first through bores in which are mounted a plurality of electrically conductive spring contacts, respectively. A second connector housing arranged on the other side of the wall opening contains a recess receiving the collar portion, and a plurality of second bores extending collinearly opposite the first bores, respectively. An electrically conductive comb member includes a plurality of integral pin portions that extend from a common spine portion through the second bores and into the first bores for electrical engagement with the spring contacts, respectively, thereby to connect conductors arranged on opposite sides of the wall. Fastener means serve to firmly connect together the housings arranged on opposite sides of the wall.

According to the invention, the conductor ends are soldered to or placed by plug connectors (for example, in the manner of bayonet-type connectors) on a comb connector. This comb connector has contact pins that are inserted through the housing of the one plug connector into engagement with spring contacts of the other plug connector.

Thus, on one side of the wall there only needs to be provided a single conductive part on the plug connector at one of the two plug connectors. For on the one hand the conductor ends can be fixed (by soldering or insertion) free of vibration in the region of the spine on the comb connector and it is also possible to configure all contact pins or the contact pins of the connector on these comb connectors, because the contact pins are so long that they can be used directly for contacting the spring contacts of the second plug connector. The solution requires only a few parts, is easy to install, and requires little maintenance.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
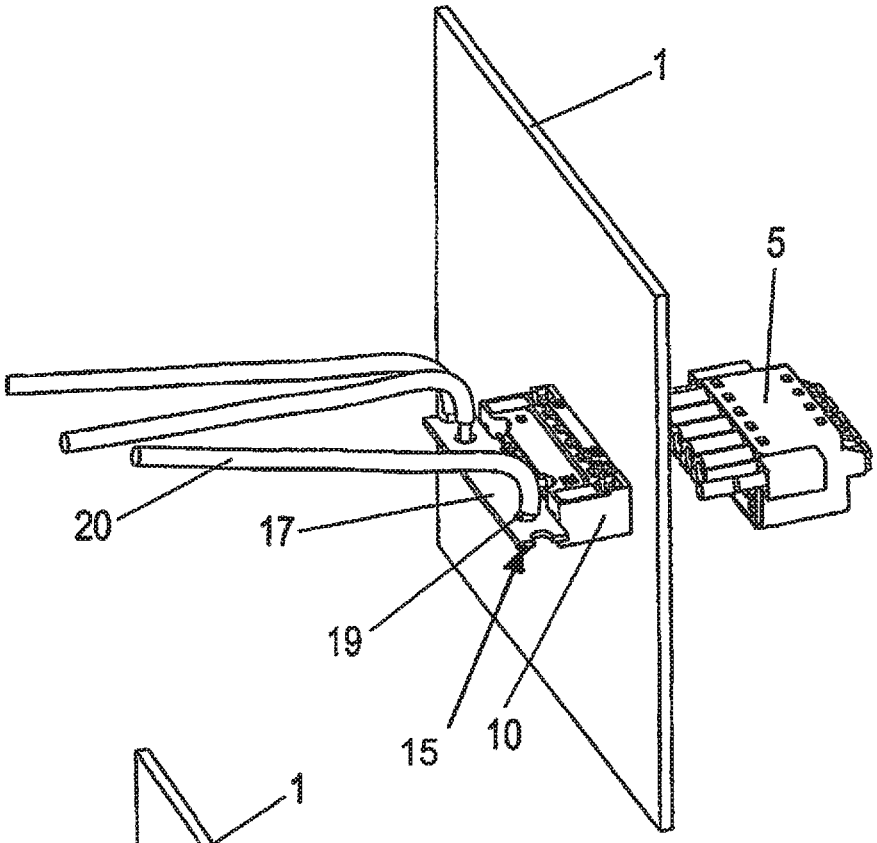
FIGS. 1*a* and 1*b* are perspective views, respectively, of two embodiments of the through-wall connector assemblies of the present invention.
Figure 1B:
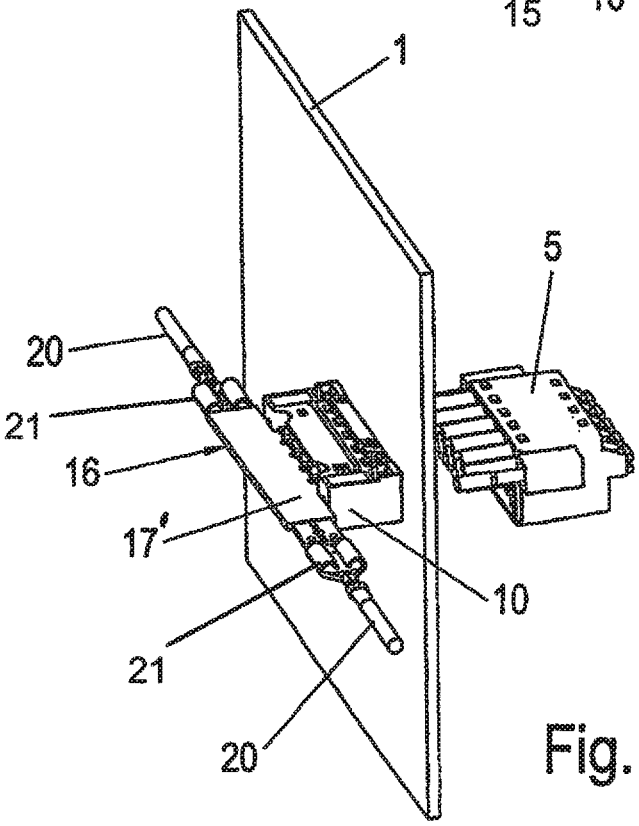
Figure 1C:
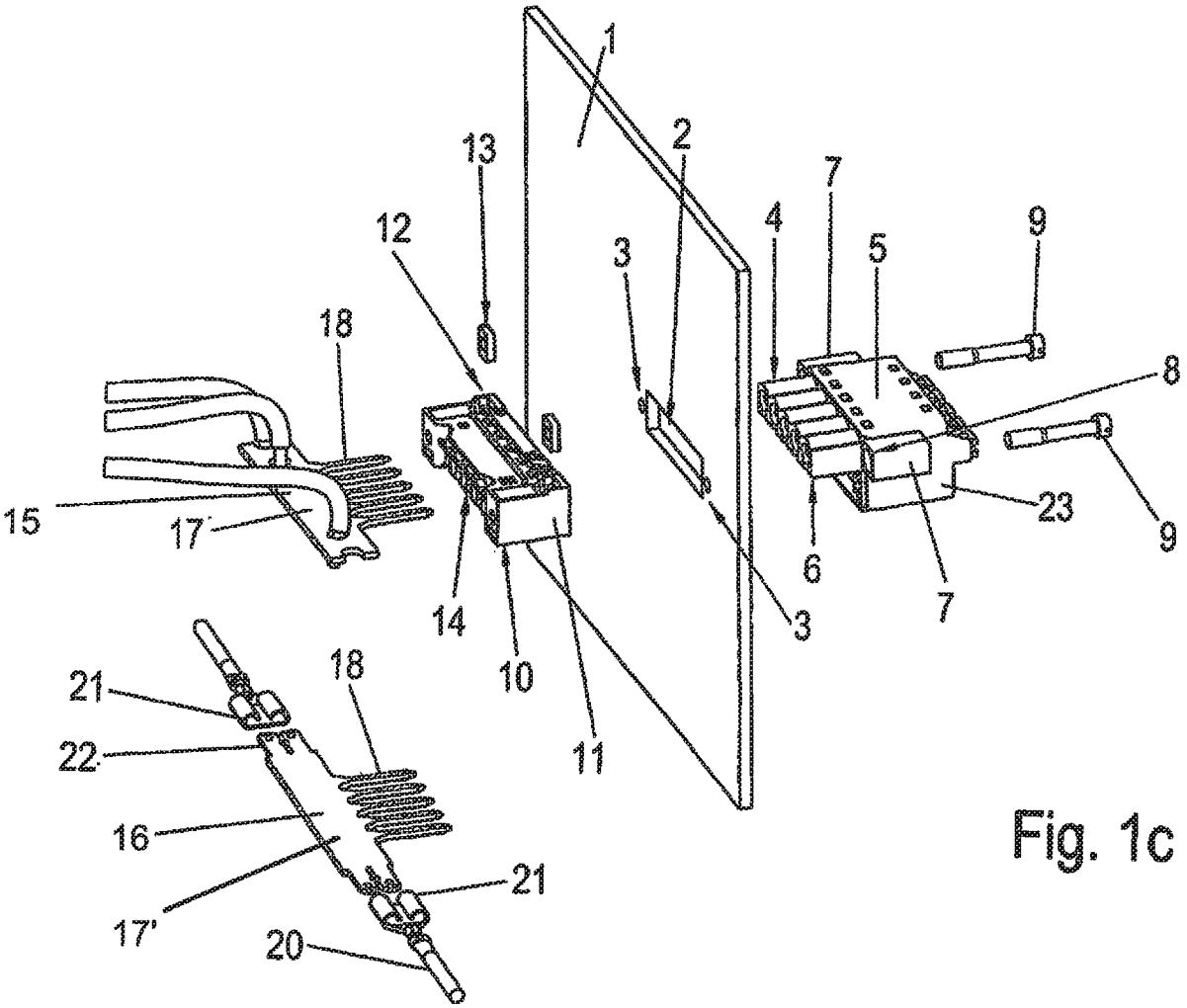
FIG. 1*c* is an exploded view of the assembly including the conductive comb members of FIGS. 1*a* and 1*b*.
Figure 1D:
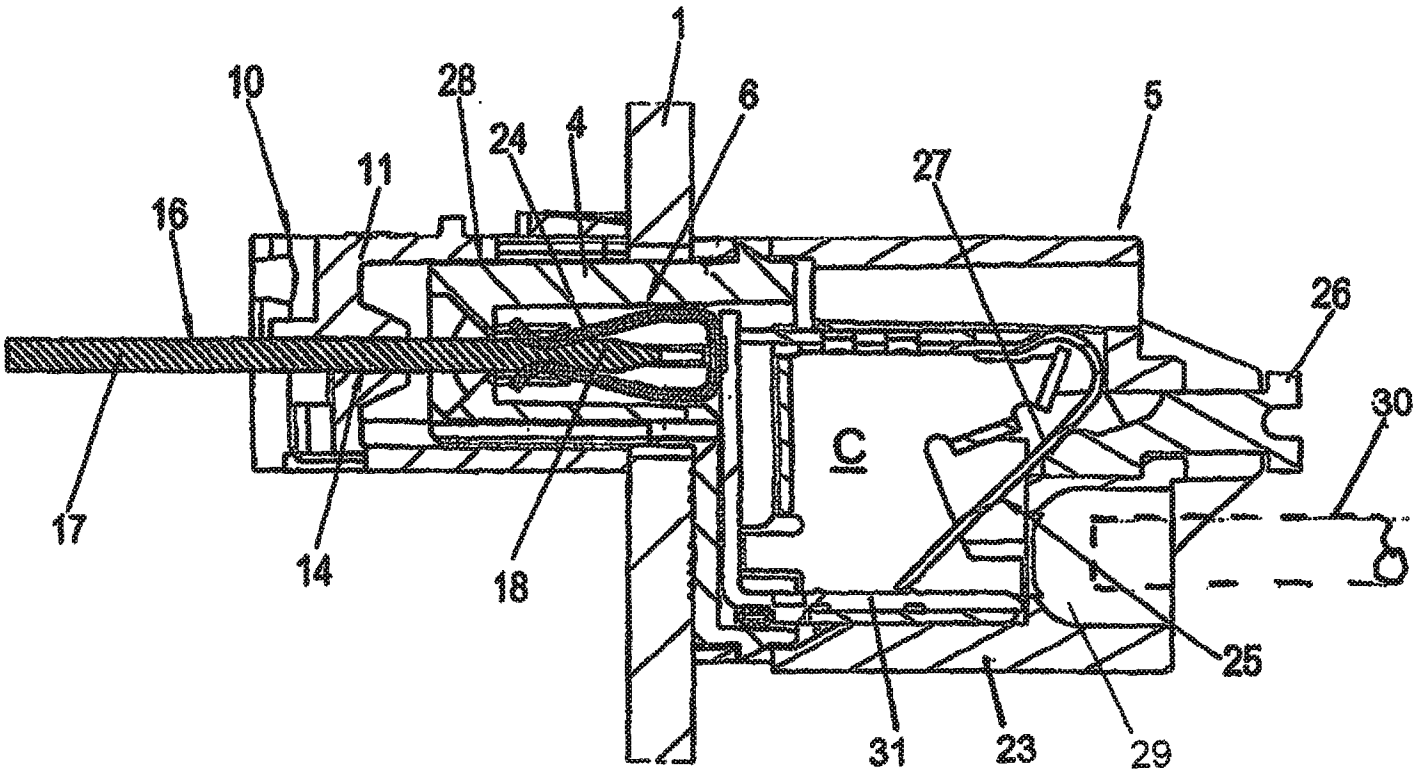
FIG. 1*d* is a sectional view of the apparatus of FIG. 1*a*, with the conductors omitted for purpose of clarity.

Referring first to FIGS. 1*a* and 1*d*, the vertical wall 1 contains a peripherally closed opening 2 in the manner of a window. The opening 2 is rectangular here in preferred configuration, but it can also have a different geometry. Through holes 3 (FIG. 1*c*) are formed in the wall on either side of narrow sides of the opening.

The wall opening 2 is configured to receive the collar portion 4 of the housing 23 of a first plug connector 5 arranged on one side of the wall. This collar portion 4 contains a plurality of parallel coplanar first through bores 6 that communicate at one end with a chamber C contained in the first plug connector housing 23. Mounted in these first bores are a plurality of tulip-shaped spring contacts 24, respectively, which spring contacts include pairs of resilient arm portions, and base portions electrically connected with stationary L-shaped contacts having leg portions 31 mounted in the bottom of the first plug connector housing chamber C adjacent access openings 29. A resilient V-shaped leaf spring 25 has a support leg secured to the top of the chamber C, and a clamping leg 27 that extends adjacent a housing access opening 29. This clamping leg 27 serves to bias toward engagement with the stationary contact portion 31 the bare end of a conductor 30 introduced into the chamber C via the access opening 29. A longitudinally displaceable push member 26 is manually operable to displace the clamping leg 27 of leaf spring 25 from its illustrated clamping position toward a retracted position relative to the stationary contact 31.

The housing 23 of the first plug connector 5 has lateral shoulders 7, which are provided with through holes 8, through which bolts 9 can be inserted. The through holes 8 are arranged on the plug connector 5 such that they are aligned with through holes 3 formed in the wall on opposite sides of the wall opening 2 when the first plug connector 5 is inserted so that its connector face collar 4 protrudes through the wall opening 2. The screws 9 are long enough to project on the other side of the wall 1 when inserted through the through holes 8.

On the other side of the wall 1 there is provided a second plug connector 10 having a second plug connector housing 11. This second plug connector housing 11 has non-circular recesses 12 for receiving nuts 13. Preferably, the recesses 12 and the nuts 13 are each rectangular in their outer circumference, so that the nuts 13 are held without twisting in the recesses 12. The recesses 12 are arranged with through holes 14 passing through them so that it is possible to install bolts 9 into the nuts 13 of the housing 11. In this way, the arrangement of the first plug connector 5 and the second plug connector 10 is fixed at the opening 2 of the wall 1.

The second plug connector housing 11 contains a recess 28 (FIG. 1*d*), which receives the end extremity of the collar portion 4 of the first plug connector 5. On the side facing away from this receptacle and the wall 1 the second plug connector housing 11 is provided with a row of second through bores 14, whose positions correspond collinearly to the positions of the first bores 6 in the collar portion of the first plug connector 5.

In simple manner, the contacting of the spring contacts 24 in the first bores 6 of the first plug connector 5 is accomplished by an electrically conductive comb connector 15 (FIG. 1*a*) or 16 (FIG. 1*b*). Each comb connector 15 or 16 has a spine portion 17, 17' from which a plurality of parallel spaced coplanar contact pins 18 project. The contact pins 18 are dimensioned so that they can be inserted through the through openings 14 into the second plug connector housing 11 to make contact with the spring contacts 24 supported in the first bores 6 of the collar portion 4 of the first plug connector 5. Owing to the spine portions 17, 17', the contact pins 18 are conductively joined together, so that the same potential exists overall on all contact pins 18 at the connection combs 15, 16.

According to the embodiment of FIG. 1*a*, the comb spine portion 17 is provided with holes 19. These holes 19 are configured such that the bare conductor ends of conductors 20 with the insulation stripped off can be inserted into them. The conductor ends can then be soldered to the lower surface of the spine portion 17. In this way, several conductors, such as three, four or more conductors can be placed on the spine portion 17 with the same potential. It is advantageous that an arrangement is created thanks to the spring contact configuration, especially in a configuration as tulip contact (24) or direct insert (push-in) contacts with clamping cage and V-shaped clamping spring, with which a long-lasting and secure contact is realized between the plug connectors 5, 10, without it being necessary to tighten up the individual contacts (which may be the case with screw contacts, for example).

In the second embodiment of FIG. 1*b*, the conductors 20 are connected to the spine portion 17' not by means of soldering but by means of bayonet connections 21 to correspondingly fashioned ends 22 of the spine. This solution as well is easy to install and requires little maintenance.

In both embodiments, electrical energy is transmitted from conductors 20 on one side of wall 1 to conductors 30 on the other side of the wall via spine portions 17, 17', pins 18, spring contacts 24, and stationary contacts 31.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector assembly for distributing electrical energy though a vertical wall opening (2), comprising:

(a) a first plug connector (5) including a generally rectangular first plug connector housing (23) arranged on one side of said vertical wall opening, said first plug connector housing containing a chamber (C) having first and second ends, said first plug connector housing having a horizontal collar portion (4) extending through said vertical wall opening, said first plug connector housing collar portion containing a plurality of horizontal parallel coplanar first through bores (6) extending longitudinally through said first plug connector housing collar portion in communication at one end with said chamber first end;

(b) a plurality of electrically conductive generally tulip-shaped spring contacts (24) arranged in said first through bores, respectively, said spring contacts having base portions adapted for connection with a plurality of first conductors (30) inserted into said chamber via access openings (29) contained in said chamber second end, respectively;

(c) a second plug connector (10) having a rectangular second plug connector housing (11) arranged on the other side of said vertical wall opening, said second plug connector housing containing a plurality of second through bores (14) opposite and extending collinearly with said first through bores, respectively;

(d) an electrically conductive comb member (15; 16) having a horizontal spine portion (17; 17'), and a plurality of parallel spaced integral pin portions (18) extending from said comb spine portion though said second through bores and into said first through bores toward electrical engagement with said spring contacts, respectively: and (e) at least one second conductor (20) having a bare end portion electrically connected with said comb spine portion, said second conductor bare end portion extending through an opening (19) contained in said comb spine portion (17) and terminating in an extremity that is soldered to said comb spine portion.

2. A connector assembly for distributing electrical energy though a vertical wall opening (2), comprising:

(a) a first plug connector (5) including a generally rectangular first plug connector housing (23) arranged on one side of said vertical wall opening, said first plug connector housing containing a chamber (C) having first and second ends, said first plug connector housing having a horizontal collar portion (4) extending through said vertical wall opening, said first plug connector housing collar portion containing a plurality of horizontal parallel coplanar first through bores (6) extending longitudinally through said first plug connector housing collar portion in communication at one end with said chamber first end;

(b) a plurality of electrically conductive generally tulip-shaped spring contacts (24) arranged in said first through bores, respectively, said spring contacts having base portions, and stationary contact portions (31) extending from said base portions into said chamber adjacent access openings (29) contained in said chamber second end, respectively;

(c) a plurality of generally V-shaped clamping springs (25) arranged in said first housing chamber adjacent said access opening, said clamping springs including clamping legs normally having clamping positions biasing into electrical engagement with said stationary contact portions the bare ends of first conductors (30) inserted into said chamber via said access openings, respectively;

(d) a second plug connector (10) having a rectangular second plug connector housing (11) arranged on the other side of said vertical wall opening, said second plug connector housing containing a plurality of second through bores (14) opposite and extending collinearly with said first through bores, respectively;

(e) an electrically conductive comb member (15; 16) having a horizontal spine portion (17; 17'), and a plurality of parallel spaced integral pin portions (18) extending from said comb spine portion though said second through bores and into said first through bores toward electrical engagement with said spring contacts, respectively;

(f) at least one second conductor (20) having a bare end portion electrically connected with said comb spine portion; and (g) further including for each of said clamping springs a displacing device (26) for displacing the associated clamping leg from said clamping position toward a released position relative to the associated stationary contact portion.

3. A connector assembly as defined in claim 2, and further including fastening means (9, 13) for fastening together said first and second plug connector housings.

4. A connector assembly as defined in claim 3, wherein said fastening means includes a threaded bolt (9) and an associated nut (13).

5. A connector assembly as defined in claim 2, wherein said second plug connector housing includes a side wall containing a recess (28) adjacent said vertical wall opening, said first housing collar portion having an end extremity extending into said recess.

* * * * *